United States Patent [19]

Long

[11] Patent Number: 4,895,188

[45] Date of Patent: Jan. 23, 1990

[54] AIR REGULATOR CONTROL FOR AIR JET LOOM

[75] Inventor: Wayne H. Long, Anderson, S.C.

[73] Assignee: Milliken Research Corporation, Spartanburg, S.C.

[21] Appl. No.: 352,054

[22] Filed: May 15, 1989

Related U.S. Application Data

[63] Continuation-in-part of Ser. No. 240,503, Sep. 6, 1988, abandoned.

[51] Int. Cl.[4] ..... D03D 47/30

[52] U.S. Cl. ..... 139/439

[58] Field of Search ..... 139/439; 226/97

[56] References Cited

U.S. PATENT DOCUMENTS 4,102,361 7/1978 Tanaka et al. .
4,143,681 3/1979 Kuda et al. .
4,187,888 2/1980 van Mullekom .
4,332,280 6/1982 Manders .
4,410,016 10/1983 Manders .
4,448,222 5/1984 Hrakawa .
4,463,783 8/1984 Suzuki et al. .
4,590,972 5/1986 Sugita et al. .
4,673,005 6/1987 Kawajiri .
4,759,392 6/1988 Bogaert et al. ..... 139/435
4,827,990 5/1989 Takeagawa ..... 139/435
4,830,063 5/1989 Takeagawa ..... 139/435

*Primary Examiner*—Henry S. Jaudon
*Attorney, Agent, or Firm*—H. William Petry; Earle R. Marden

[57] ABSTRACT

An air supply system which insures that maximum air is supplied to the auxiliary jets of an air jet weaving machine upon start-up and automatically reduces the air supply when the weaving machine has reached equilibrium.

7 Claims, 1 Drawing Sheet

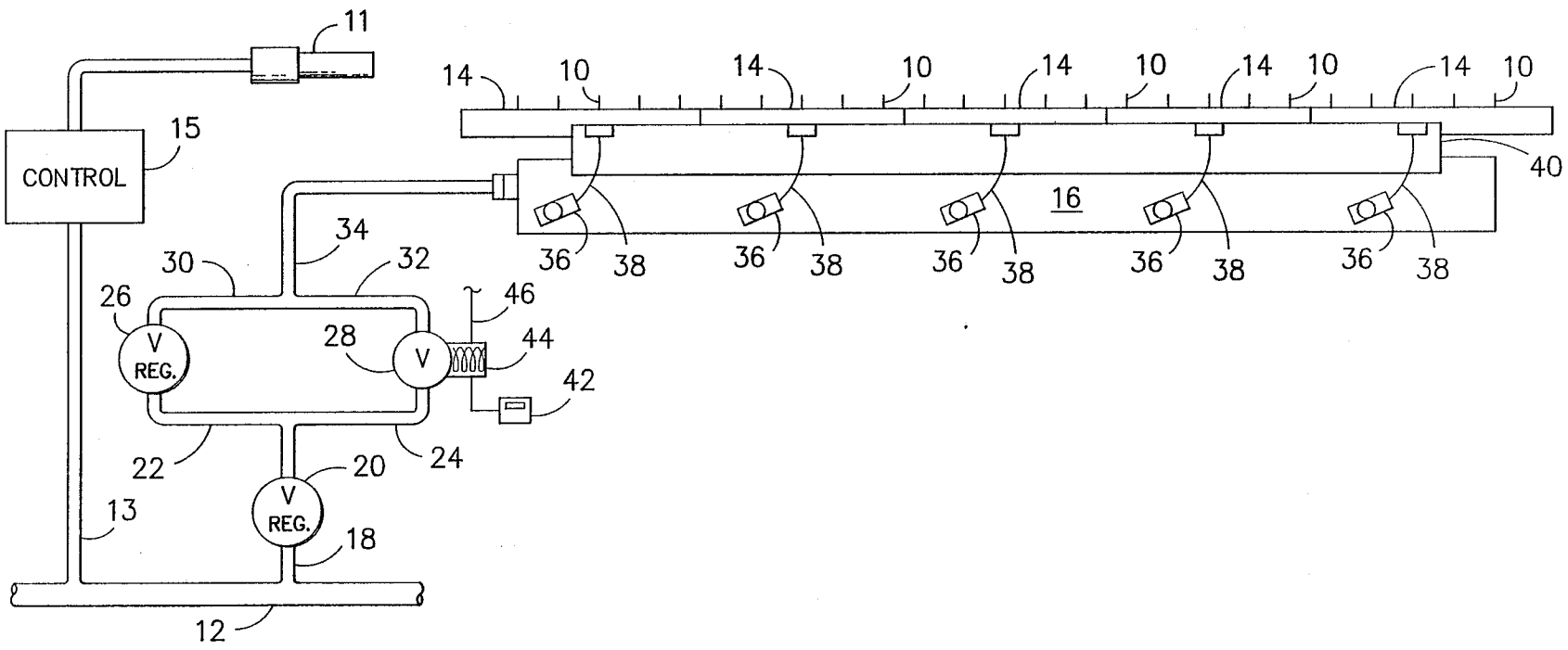
CONTROL
V
REG.
V
REG.
V
10
14
16
11
12
13
15
18
20
22
24
26
28
30
32
34
36
38
40
42
44
46

AIR REGULATOR CONTROL FOR AIR JET LOOM

This application is a C-I-P of U.S. application Ser. No. 240,503, filed Sept. 6, 1988, now abandoned.

The invention relates to fluid-jet weaving machines and more particularly to apparatus within such machines for distributing pressurized fluid to a plurality of auxiliary active elements forming part of the weft insertion apparatus of the weaving machine.

In known distributing arrangements of this type, a plurality of successively operated, solenoid-controlled valves are employed to couple air or other pressurized fluid to the successive active elements in the insertion apparatus. The timing of operation of the successive valves is so chosen as to collectively form a progressively moving pressure wave along the shed, thereby augmenting the propelling effect of the main insertion nozzle of the machine. It is therefore an object of the invention to provide an air control system for a fluid-jet weaving machine which will provide maximum air flow upon start-up and maintain desired air flow during stabilized machine operation.

Other objects and advantages of the invention will become readily apparent as the specification proceeds to describe the invention with reference to accompanying drawing.

The drawing schematically represents the air supply system for an air jet weaving machine.

In the past a preset amount of air has been supplied to the auxiliary or subnozzle jets of an air jet weaving machine to assist the passage of the fill yarn across the loom after it has been propelled initially by the main nozzle 11 supplied with air under pressure from the air source 12 through the control 15. The control 15 schematically represents the air pressure controls for the main nozzle of U.S. Pat. No. 4,673,005 which are described as acting to increase the air pressure at start-up of the weaving machine and lowering the air pressure for normal operation. It has been found that upon start-up however it is more efficient to also supply an increase of air pressure to the subnozzles so as to effect efficient lay-in of the first 200–300 fill yarns and then reduce the air supplied to a lower level once the weaving machine has reached the normal or equilibrium operating level. The subnozzle air control is separate and independent from the control 15 for the main nozzle.

The drawing indicates a schematic representation of the preferred air control system for the auxiliary or subnozzles 10 of an air jet loom or weaving machine (not shown). Air from a compressor (not shown) is supplied through conduit 12 at a pressure of about 6.3–7.8 kgs/cm$^2$ to the main nozzle and each of the subnozzles control systems for each of the air jet looms or weaving machines. In the preferred form of the invention, the subnozzles are grouped in sets so that all the subnozzles 10 in a set are supplied air at the same pressure from the same sub-receiver 14. Obviously, if desired, each subnozzle could be supplied air separately from the main air tank or container 16.

To supply air to the subnozzles 10 a conduit 18 is connected to the main air line 12 at one end and a pressure regulator valve 20 at the other end. The pressure regulator valve 20 reduces the main line air pressure to about 5 kgs/cm$^2$ and supplies it to the conduits 22 and 24 of the air control system.

Air conduit 22 is connected to the pressure regulator valve 26 while the air conduit 24 is connected to the solenoid controlled regulator valve 28. Air conduits 30 and 32, respectively, are connected to the output side of pressure regulator valve 26 and the solenoid valve 28 and supply air to the air conduit 34. The air conduit 34 supplies air under pressure to the air tank or receiver 16 which supplies air to each of the sub-receivers 14 through solenoid controlled regulator valves 36 ad conduits 38, mounted on the sleigh 40 of the loom and connected to the respective subreceivers 14 and subnozzles 10.

OPERATION

The pressure regulator valve 26 is set to deliver air at the operating pressure of 2–4 kgs/cm$^2$ while the solenoid controlled regulator valve, when open, delivers air at the increased line pressure of 5 kgs/cm$^2$.

Whenever the weaving machine is stopped the solenoid valve 28 is readied to supply the higher pressure air to the tank or receiver 16. This higher pressure air is available to the subnozzles 10 when the solenoid controlled regulator valves 36 are actuated to allow air to pass from the tank 36 to the sub-receivers 14.

Upon start-up of the weaving machine, air is supplied to the air tank 16 through the valve 28. After a predetermined length of time, preferably 25 seconds, the timer 42 will cause current to be supplied via the electrical connection 46 to the coil 44 of the solenoid controlled regulator valve 28 to close same to stop the flow of higher pressure air from the conduit 24. Then the lower pressure air of 2–4 kgs/cm$^2$ will be supplied by the pressure regulator valve 26 via conduits 22, 30 and 34 to the air tank 16 to be used on demand depending on the control of the solenoid controlled regulator valves 36. This will be the normal weaving or operating position of the air control system. If the weaving machine stops for any reason, the valve 28 will be opened again and the above-described sequence repeated.

The above-described system provides a much more efficient start-up and at the same time reduces the amount of air necessary for normal weaving conditions. As an example, prior to the installation of the described system the average air usage was 30–35 CFM which dropped to 22–25 CFM after the installation of the subject system. Not counting the more efficient start-up conditions, the drop in air usage resulted in a 27% savings for each weaving machine. This is substantial when you consider 500–600 looms per plant.

Although the preferred embodiment of the invention has been described specially, it is contemplated that changes may be made without departing from the scope or spirit of the invention and it is desired that the invention be limited only by the scope of the claim.

I claim:

1. An air supply system for an air jet weaving machine comprising: a main air supply means for supplying air under pressure, a primary air jet to project yarn into a shed, means to supply air from said air supply means to said primary air jet, a container for air under pressure, a plurality of auxiliary air jet nozzles, means to supply air under pressure from said container to said auxiliary air jet nozzles, conduit means supplying air under pressure to said container and valve means connected to said conduit means between said container and said supply means to provide that air at a first pressure is supplied to said container upon start-up of the air jet weaving machine and that air at a lower second pressure is supplied to said container after a predetermined time after start-up.

2. The system of claim 1 wherein said valve means includes at least two air conduits in communication with said conduit means, a pressure regulator valve means operably associated with one of said two conduits to supply the air at said second pressure to said container and a solenoid controlled regulator valve means associated with the other of said conduits to supply upon command said air at said first pressure to said container.

3. The system of claim 1 wherein a plurality of air receivers are operably associated with said air container, each air receiver having a plurality of air jet nozzles connected thereto and valve means connected to said container and each of said air receivers to control the flow of air under pressure from said air container to each of said air receivers.

4. The system of claim 3 wherein said air at said first pressure is about 5 kgs/cm.

5. The system of claim 2 wherein said second air pressure is in the range of 2–4 kgs/cm.

6. The system of claim 2 wherein said air at said first pressure is about 5 kgs/cm.

7. The system of claim 2 wherein a plurality of air receivers are operably associated with said air container, each air receiver having a plurality of air jet nozzles connected thereto and valve means connected to said container and each of said air receivers to control the flow of air under pressure from said air container to each of said air receivers.

* * * * *